US008347474B2

(12) United States Patent
Oachs et al.

(10) Patent No.: US 8,347,474 B2
(45) Date of Patent: Jan. 8, 2013

(54) BRAKE DRUM/BRAKE ROTOR REMOVAL TOOL

(75) Inventors: Joshua Oachs, Racine, WI (US); Maximilian N. Knoell, Racine, WI (US)

(73) Assignee: A & E Incorporated, Racine, WI (US)

( * ) Notice: Subject to any disclaimer, the term of this patent is extended or adjusted under 35 U.S.C. 154(b) by 331 days.

(21) Appl. No.: 12/907,145

(22) Filed: Oct. 19, 2010

(65) Prior Publication Data

US 2011/0179616 A1 Jul. 28, 2011

Related U.S. Application Data

(60) Provisional application No. 61/298,700, filed on Jan. 27, 2010.

(51) Int. Cl.
*B25B 27/02* (2006.01)

(52) U.S. Cl. ..... 29/259; 29/261; 29/255; 29/244

(58) Field of Classification Search ..... 29/259, 29/255, 270, 278, 261, 271
See application file for complete search history.

(56) References Cited

U.S. PATENT DOCUMENTS

| | | | | |
|---|---|---|---|---|
| 1,172,761 | A * | 2/1916 | Berkstresser | 29/259 |
| 1,889,965 | A | 12/1932 | Kendall | |
| 2,262,969 | A | 11/1941 | Schultz | |
| 2,296,119 | A | 9/1942 | Ringrose | |
| 3,315,340 | A * | 4/1967 | King | 29/267 |
| 3,402,455 | A | 9/1968 | Converse | |
| 3,689,978 | A | 9/1972 | Kelso | |
| 4,649,615 | A | 3/1987 | Hundley | |
| 4,908,925 | A * | 3/1990 | Johnson | 29/260 |
| 4,989,311 | A * | 2/1991 | Rosin | 29/259 |
| 6,581,265 | B2 | 6/2003 | Sawaya | |
| 6,925,696 | B1 * | 8/2005 | Williams | 29/252 |
| 2011/0179616 | A1 * | 7/2011 | Oachs et al. | 29/259 |

* cited by examiner

*Primary Examiner* — Lee D Wilson

(74) *Attorney, Agent, or Firm* — Ryan Krumholz & Manion, S.C.

(57) ABSTRACT

A pulling tool includes a elongated main support body having a plurality of retention holes formed on opposite sides thereof. An actuator stem member is threadably mounted in the support body. A pair of jaw members is slidably mounted on opposite side of the support body. The jaw members have extended hook portions adapted to engage an outer periphery of a wheel element removably mounted on a stationary wheel mounting member. A pair of tubular holders is slidably mounted on opposite sides of the support body, and retained against outer faces of the jaw members to prevent lateral outward movement of the jaw members on the support body and to orient the jaw members substantially perpendicularly to the support body.

12 Claims, 3 Drawing Sheets

BRAKE DRUM/BRAKE ROTOR REMOVAL TOOL

CROSS REFERENCE TO RELATED APPLICATION

The present application relates to and claims priority from U.S. Provisional Application Ser. No. 61/298,700 filed Jan. 27, 2010, which is fully incorporated herein by reference.

FIELD

The present disclosure relates generally to manually-operated tools, and more particularly, pertains to a hand tool for easily removing a brake drum, a brake rotor or similar removable element from a stationary supporting or mounting element, such as a wheel hub.

BACKGROUND

During repair or maintenance of a vehicle, it is frequently necessary to remove wheel elements, such as brake drums and/or brake rotors from axles or wheel hubs. However, tolerances between brake drums or rotors and their wheel hubs is extremely small. Because of the small tolerances, and because wheel hubs bear the weight of the vehicle, extended use of the vehicle can cause the brake drum or brake rotor to become essentially fused or seized on the wheel hub.

Once a wheel element, such as a brake drum or brake rotor, becomes seized on the wheel hub, it can be very difficult to remove the wheel element from the vehicle by hand. Common practice in the vehicle repair industry is to have a mechanic hoist the vehicle, heat the seized wheel element and then hammer on the wheel element from the inside until the brake drum or brake rotor becomes loose enough to remove.

This method, however, can cause damage to the brake drum, brake rotor, wheel bearing or other parts of the vehicle during hammering. Further, this operation can be labor intensive and can jeopardize the safety of the mechanic when hammering the wheel element while under the vehicle.

In order to address these problems, the prior art provides a number of different wheel pulling devices to assist in removal of brake drums, brake rotors, or other similar elements from their mountings on a vehicle. Such devices typically include a main support bar, an actuator screw threaded through a mid-portion of the support bar, and working jaw members removably mounted on opposite ends of the support bar. In use of a conventionally known wheel pulling device, the jaw members are engageable with outer peripheries of the brake drum or brake rotor and the actuator screw is threaded through the support bar against the wheel hub or wheel axle to apply a pulling force against the brake drum or brake rotor through the jaw members. However, the placing and holding of the jaw members in engagement with a brake drum or brake rotor while also rotating the actuator screw proves to be extremely difficult, if not impossible, by one using his own two hands.

Thus, it remains desirable to provide a removal tool for extracting a wheel element, such as a brake drum or brake rotor, from a wheel supporting element, such as a wheel hub, in a manner which improves upon prior art devices, and is efficiently utilized for exerting a quick and uniform pulling force.

SUMMARY OF THE INVENTION

The present disclosure relates to a pulling tool for separating a removable wheel element, such as a brake drum or brake rotor, from a stationary wheel mounting member, such as a hub or axle. The pulling tool includes an elongated main support body having a plurality of retention holes formed on opposite ends thereof. An actuator stem member is threadably mounted in the support body. A pair of jaw members is slidably mounted on opposite sides of the support body. The jaw members have extended hook portions adapted to engage an outer periphery of a wheel element removably mounted on a stationary wheel mounting member. A pair of tubular holders is slidably mounted on opposite sides of the support body and retained against outer faces of the jaw members to prevent lateral outward movement of the jaw members on the support body and to orient the jaw members substantially perpendicularly to a longitudinal axis of the support body. A handle projects from the support body and the jaw members have detents which are engaged in the retention holes of the support body when the hook portions are engaged with the outer periphery of the wheel element.

The retention holes are spaced apart equidistantly from each other. The support body is formed with a threaded center hole for threadably receiving and retaining the actuator stem member. The actuator stem member has an externally threaded main outer body with an upper end provided with a non-threaded cylindrical portion and a wrench engageable portion adapted to receive a turning wrench. The actuator stem member has a lower end provided with a cylindrical adapter adapted to engage the stationary wheel mounting member. The cylindrical adapter is magnetically attached to the lower end of the actuator stem member. Each jaw member has an elongated body portion having an upper mounting end and a lower gripping end. Each upper mounting end has an opening defined by at least one wall, the opening being sized to enable the jaw member to slide upon the support body into alignment over an area defined by the retention holes. Each detent projects downwardly from the wall defining the opening and is engageable in a selected one of the retention holes. Each tubular holder is provided with a threaded aperture for receiving a thumb screw that frictionally engages the support body to retain the tubular holder in a selected position. The handle is located between the actuator stem member and one set of retention holes on one end of the support body. The jaw members are spaced equidistantly from the center hole of the support body.

BRIEF DESCRIPTION OF THE DRAWINGS

The best mode of carrying out the invention is described herein below with reference to the following drawing figures.

DETAILED DESCRIPTION

Figure 1:
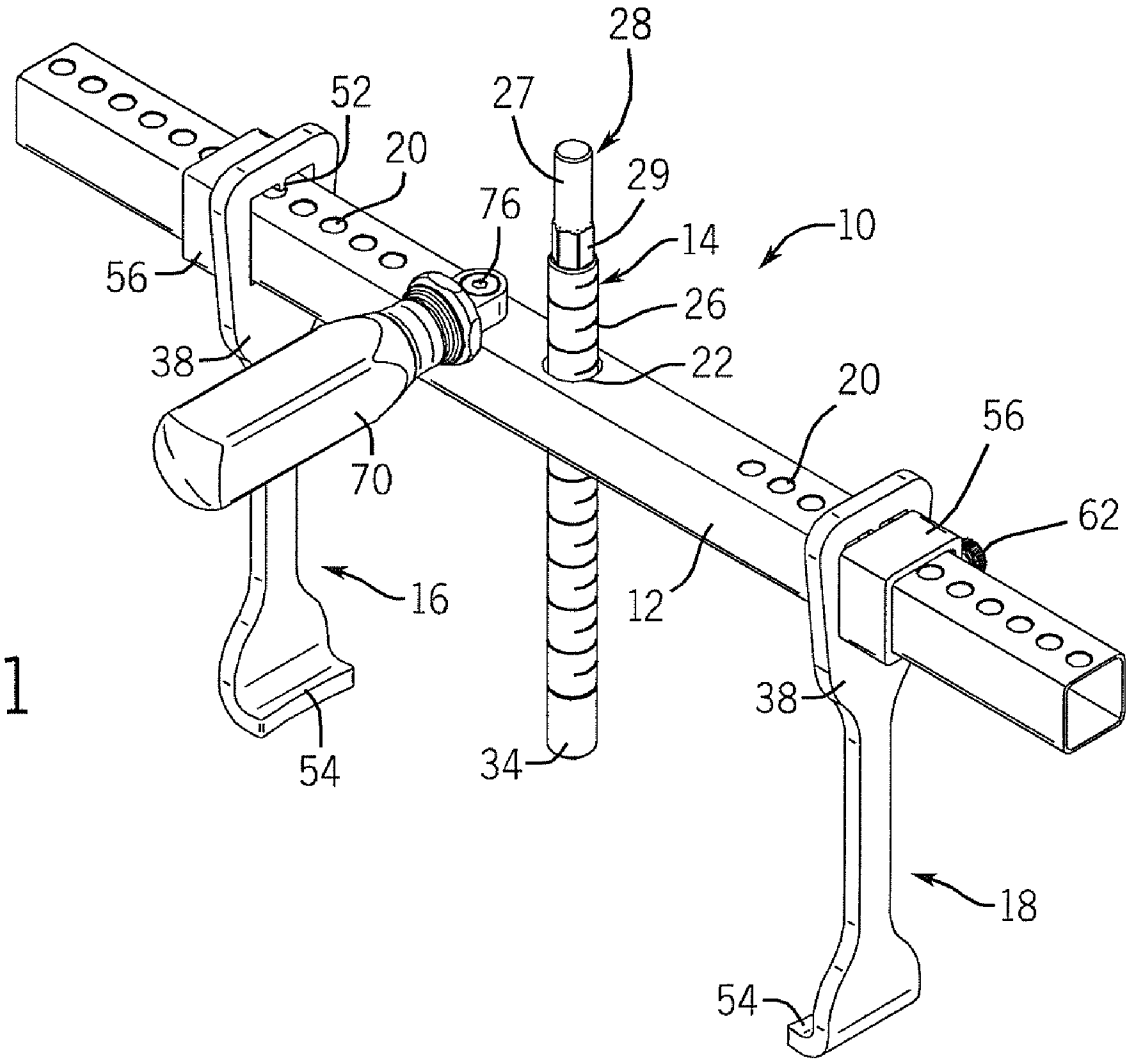
FIG. 1 is a perspective view of an assembled brake drum or brake rotor removal tool in accordance with the present disclosure.
Figure 2:
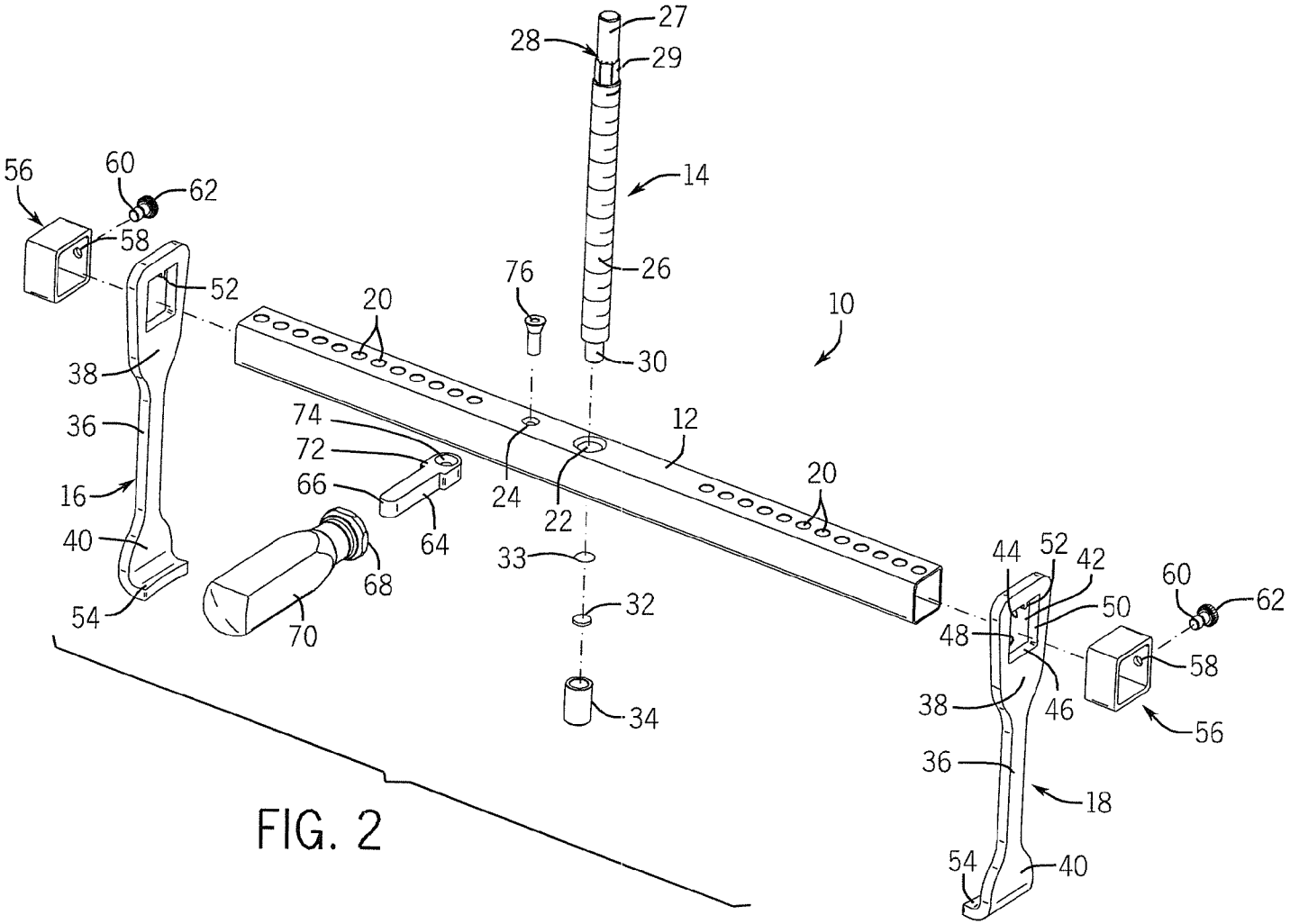
FIG. 2 is an exploded view of FIG. 1.
Figure 3:
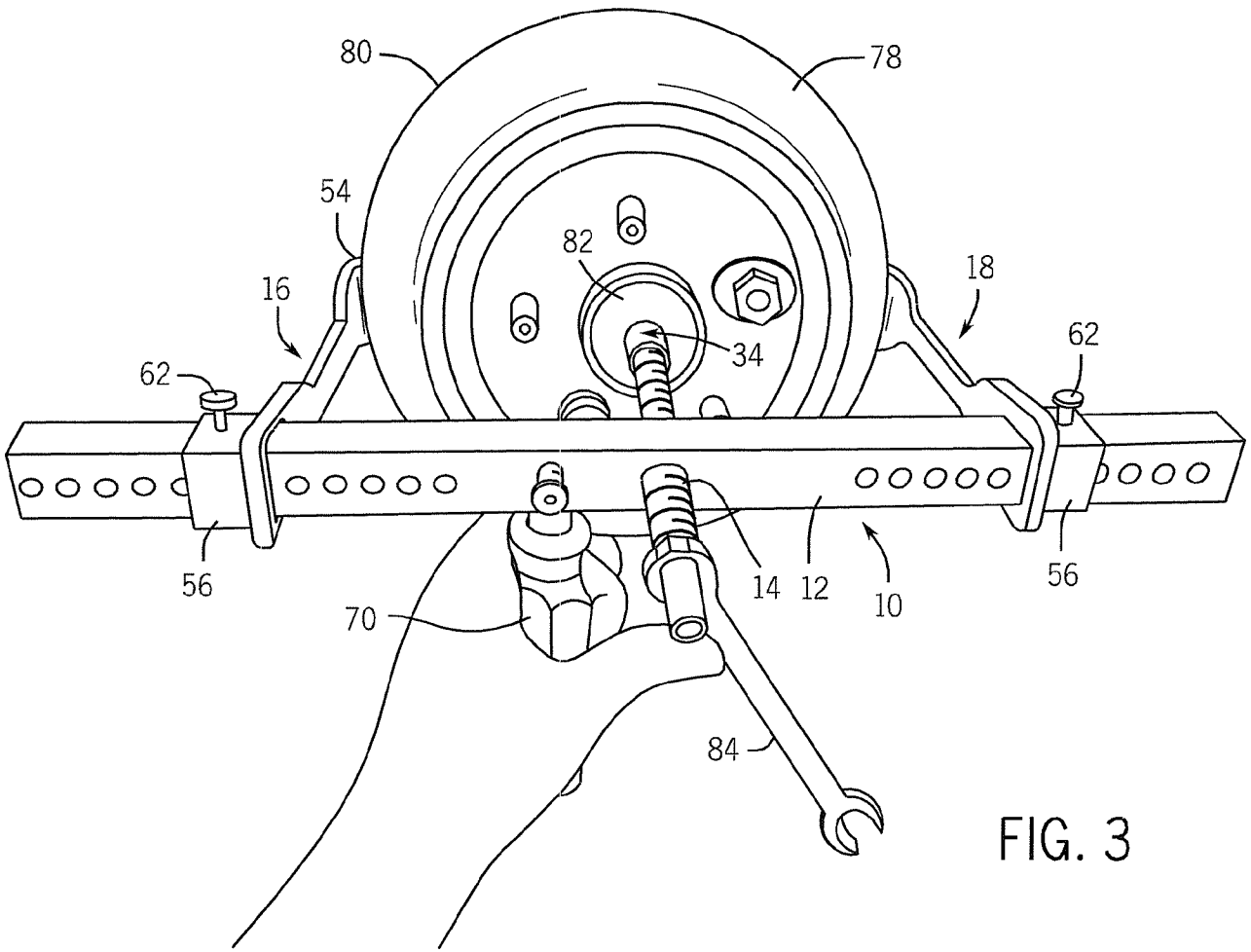
FIG. 3 is a perspective view of the removal tool of FIG. 1 in use.

Referring now to FIGS. 1-3, thereshown is a wheel pulling tool 10 for separating a removable wheel element, such as a brake drum or brake rotor, from a stationary wheel support such as a wheel hub or axle.

The tool 10 basically comprises a main support body 12, an actuator stem member 14 threadably mounted in a central portion of the support body 12, and a pair of jaw members 16, 18 removably connected to opposite ends of the support body 12.

The support body 12 is an elongated, rigid center bar of generally rectangular shape in transverse cross section having a series of non-threaded retention holes 20 formed thereon on opposite sides of the bar 12. Retention holes 20 are spaced apart equidistantly from each other, and are all formed with substantially identical diameters. The bar 12 is also provided with a threaded center hole 22, as well as a threaded recess 24 located between one set of retention holes 20 and the center hole 22 on one side of the bar 12. Both the center hole 22 and the recess 24 have longitudinal axes parallel to each other and the respective longitudinal axes of the retention holes 20. In the preferred embodiment, the center bar 12 has a length of 17 inches and is constructed of a steel alloy which is heat treated.

The actuator stem member 14 takes the form of an elongated center screw having an externally threaded main outer body 26 which is threadably engageable with internal threads formed in center hole 22. The body 26 includes an upper end 28 provided with a non-threaded cylindrical portion 27 and a socket-preventing, a wrench only-engageable hex head configuration 29, and a lower end 30 having a diameter which is smaller than the diameter of the threaded body 26. Cylindrical adapter 34 receives a magnet 32 which is held in place by a retention disk 33, so that adapter 34 is magnetically held to lower end 30. Upper end 28 is adapted to receive a turning wrench thereon in use, while adapter 34 is designed to engage a wheel hub as will be explained.

The jaw members 16 and 18 are substantially identical metallic elements and are configured to be slidably and perpendicularly mounted along the opposite sides of bar 12 at various positions thereof defined by the retention holes 20. Each jaw member 16, 18 includes an elongated body portion 36 having an upper mounting end 38 and lower gripping end 40. Each upper mounting end 38 has an opening 42 defined by an upper wall 44, a lower wall 46 and side walls 48, 50. Each upper wall 44 of jaw member 16, 18 is provided with a downwardly depending detent member 52 which is adapted to be engaged in one of the retention holes 20. Each opening 42 is suitably sized to enable the jaw members 16, 18 to be slidably positioned along the opposite sides of bar 12 over the area defined by the retention holes 20. Each lower gripping end 40 has a laterally extending hook portion 54 designed to maximize surface contact and provide a uniform grip with outer ends of a removable member such as a brake drum or brake rotor. Preferably, each hook portion 54 extends from the elongated body portion 36 at about an 85° angle. It is noted that hook portions 54 are adapted to face inwardly towards each other for reasons to become obvious. Jaw members 16, 18 may vary in length and size as desired.

The tool 10 includes a pair of metallic tubular holders or collars 56 which are slidably received and retained along the bar 12, and are engageable against outer faces of the jaw members 16, 18 at upper mounting ends 38 thereof. Each holder 56 is suitably shaped for sliding movement along bar 12 and includes a small threaded aperture 58 formed through one wall thereof. Each threaded aperture 58 receives a threaded shaft 60 of a thumb screw 62 used to retain the holder 46 in a selected position along bar 12 by frictional engagement therewith.

The tool 10 further includes a handle insert 64 having a solid rear end 66 which is retained in an open end 68 of a plastic handle 70. The handle insert 64 has a front end 72 provided with a hole 74 which is aligned with the threaded recess 24 in bar 12. A threaded screw 76 is passed through the hole 74 and screwed into the threaded recess 24 to secure handle 70 to the bar 12. Handle 24 may be appropriately secured to the bar 12 for either right handed or left handed users of tool 10.

An exemplary use of the tool 10 for a right handed user will now be described with reference to FIG. 3. Initially, the handle 70 is attached to the bar 12 and the center screw 14 is threaded about half way down in the bar 12. The jaw members 16, 18 are slidably positioned on each side of the bar 12 with the detents 52 facing the retention hole 20 and with the hook portions 54 facing inwardly. With the jaw members 16, 18 extending forwardly, the holders 56 with the thumb screws 62 partially threaded in the holes 58, are slidably moved along the bar 12. Then, holding the tool 10 up to a brake drum 78, jaw members 16, 18 are positioned so that the hook portions 54 engage an outer circumferential lip 80 of the brake drum 78. Center screw 14 is turned by hand so that adapter 34 engages the center of a wheel hub 82 or the like. Next, the jaw members 16, 18 are positioned so that they are as close to perpendicular to the bar 12 as possible with detents 52 aligning with respective retention holes 20 in the bar 12. Jaw members 16, 18 should be equidistantly spaced from the center hole 22 of bar 12 and enable the hook portions 54 to firmly grab behind the outer lip 80 of brake drum 78 while maintaining contact of the adapter 34 against the center of hub 82. The holders 56 are then engaged against the outer faces of the jaw members 16, 18 with the detents 52 engaged in selected retention holes 20 (see FIG. 1), and the thumb screws 62 are tightened to prevent an axial or lateral outward movement of the jaw members 16, 18 on the bar 12. Using a wrench 84, the center screw 12 is turned towards the center of hub 82 to create tension on the brake drum 78. Continuing to hold the tool 10 in position with one's left hand on handle 70, the user's right hand is provided with a hammer (not shown) for gently tapping around the outer edges of the brake drum 78 and the center of hub 82 until brake drum 78 is freed from hub 82. Once the brake drum 78 is carefully removed from hub 82, thumb screws 62 are loosened so that holders 56 and jaw members 16, 18 are released along the bar 12.

The removal tool 10 as described above saves time and reduces the need to repeatedly strike or heat the brake drum or similar removable wheel element from the hub or other mounting elements so as to prevent damage to the wheel bearing. The bar 12 and the jaw members 16, 18 can be suitably sized to accommodate the various removable wheel elements. The hook portions 54 on the jaw members 16, 18 are specially designed to maximize surface contact ensuring a uniform grip on deteriorated brake drums or other elements. The bar 12 is heated treated steel to withstand high reaction forces while remaining compact and relatively easy to handle. The locking holders 56 allow fast, simple jaw adjustments and provide support to keep the jaw members 16, 18 aligned during use. Handle 70 can be attached to the bar 12 to accommodate right or left handed users.

While the invention has been described with reference to a preferred embodiment, those skilled in the art will appreciate that certain substitutions, alterations and omissions may be made without departing from the spirit thereof. Accordingly, the foregoing description is meant to be exemplary only and should not be deemed limitative on the scope of the invention set forth with the following claims.

What is claimed is:

1. A pulling tool adapted to separate a removable wheel element from a stationary wheel mounting member, the tool comprising:

an elongated main support body having a set of retention holes on opposite ends thereof, and a handle projecting therefrom;

an actuator stem member threadably mounted in the support body;

a pair of jaw members slidably mounted on opposite sides of the support body, the jaw members having hook portions adapted to engage an outer periphery of the wheel element removably mounted on the wheel mounting member, and detents engageable in the retention holes when the hook portions are engageable with the wheel element; and a pair of tubular holders slidably mounted on opposite sides of the support body and retained against outer faces of the jaw members to prevent lateral outward movement of the jaw members on the support body and to orient the jaw members substantially perpendicularly to a longitudinal axis of the support body.

2. The pulling tool of claim 1, wherein the retention holes are spaced apart equidistantly from each other.

3. The pulling tool of claim 1, wherein the support body is formed with a threaded center hole for threadably receiving and retaining the actuator stem member.

4. The pulling tool of claim 1, wherein the actuator stem member has an externally threaded main outer body with an upper end provided with a non-threaded cylindrical portion and a wrench engageable portion adapted to receive a turning wrench.

5. The pulling tool of claim 1, wherein the actuator stem member has a lower end provided with a cylindrical adapter adapted to engage the stationary wheel mounting member.

6. The pulling tool of claim 5, wherein the cylindrical adapter is magnetically attached to the lower end of the actuator stem member.

7. The pulling tool of claim 1, wherein each jaw member has an elongated body portion having an upper mounting and a lower gripping end.

8. The pulling tool of claim 7, wherein each upper mounting end has an opening defined by at least one wall, the opening being sized to enable the jaw member to slide upon the support body into alignment with an area defined by the retention holes.

9. The pulling tool of claim 8, wherein each detent projects downwardly from the wall defining the opening and is engageable in a selected one of the retention holes.

10. The pulling tool of claim 1, wherein each tubular holder is provided with a threaded aperture for receiving a thumb screw that frictionally engages the support body to retain the tubular holder in a selected position.

11. The pulling tool of claim 1, wherein the handle is located between the actuator stem member and one set of retention holes on one end of the support body.

12. The pulling tool of claim 3, wherein the jaw members are spaced equidistantly from the center hole of the support body.

* * * * *

UNITED STATES PATENT AND TRADEMARK OFFICE

CERTIFICATE OF CORRECTION

PATENT NO. : 8,347,474 B2
APPLICATION NO. : 12/907145
DATED : January 8, 2013
INVENTOR(S) : Joshua Oachs and Maximillian N. Knoell It is certified that error appears in the above-identified patent and that said Letters Patent is hereby corrected as shown below:

Title page, item (74) Attorney, agent, or Firm – delete "Ryan Krumholz & Manion, S.C." and insert -- Ryan Kromholz & Manion, S.C. --

Signed and Sealed this
Twenty-sixth Day of March, 2013

Teresa Stanek Rea
*Acting Director of the United States Patent and Trademark Office*